US011611149B2

(12) United States Patent
Chan et al.

(10) Patent No.: US 11,611,149 B2
(45) Date of Patent: Mar. 21, 2023

(54) LEAKY-WAVE ANTENNA

(71) Applicant: City University of Hong Kong, Kowloon (HK)

(72) Inventors: Chi Hou Chan, Kowloon (HK); Gengbo Wu, Guangdong (CN); Ka Fai Chan, New Territories (HK)

(73) Assignee: City University of Hong Kong, Kowloon (HK)

( * ) Notice: Subject to any disclaimer, the term of this patent is extended or adjusted under 35 U.S.C. 154(b) by 63 days.

(21) Appl. No.: 17/358,325

(22) Filed: Jun. 25, 2021

(65) Prior Publication Data

US 2022/0416432 A1 Dec. 29, 2022

(51) Int. Cl.

| | |
|---|---|
| ***H01Q 13/20*** | (2006.01) |
| ***H01Q 13/28*** | (2006.01) |
| ***H01P 3/16*** | (2006.01) |

(52) U.S. Cl.

CPC ..... *H01Q 13/28* (2013.01); *H01P 3/16* (2013.01); *H01Q 13/206* (2013.01)

(58) Field of Classification Search

CPC ..... H01Q 1/38; H01Q 13/20; H01Q 13/206; H01Q 13/28; H01Q 13/00; H01P 3/16

See application file for complete search history.

(56) References Cited

U.S. PATENT DOCUMENTS

| | | | | |
|---|---|---|---|---|
| 4,468,673 | A * | 8/1984 | Stern | H01Q 3/22 343/770 |
| 4,618,865 | A * | 10/1986 | Lamensdorf | H01Q 21/065 343/785 |
| 5,757,331 | A * | 5/1998 | Yoneyama | H01Q 21/0068 333/248 |
| 6,340,951 | B1 | 1/2002 | Sheen | |
| 8,197,473 | B2 | 6/2012 | Rossetto et al. | |
| 8,836,594 | B2 | 9/2014 | Rothwell | |
| 9,490,518 | B1 * | 11/2016 | Herbsommer | H01Q 1/24 |
| 10,014,585 | B2 | 7/2018 | Patron et al. | |
| 10,522,900 | B2 | 12/2019 | Khripkov et al. | |
| 2009/0243950 | A1 * | 10/2009 | Manasson | H01Q 13/02 343/785 |
| 2010/0311369 | A1 | 12/2010 | Rofougaran et al. | |
| 2021/0194105 | A1 * | 6/2021 | Uemichi | H01P 3/121 |

* cited by examiner

*Primary Examiner* — Tho G Phan

(74) *Attorney, Agent, or Firm* — Renner Kenner Greive Bobak Taylor & Weber

(57) ABSTRACT

A leaky-wave antenna includes a substrate extending along an axis, and a dielectric waveguide extending along the axis and arranged in the substrate. The dielectric waveguide includes at least a top side, a bottom side, and opposite sides arranged between the top and bottom sides. A distance defined between the opposite sides varies along the axis for at least part of a length of the dielectric waveguide.

28 Claims, 18 Drawing Sheets
(1 of 18 Drawing Sheet(s) Filed in Color)

LEAKY-WAVE ANTENNA

TECHNICAL FIELD

The invention relates to leaky-wave antennas.

BACKGROUND

Leaky-wave antennas, which support traveling wave with progressive leakage along the wave-guiding structure, are used in various applications such as imaging, automotive radar, and direction of arrival estimation, etc.

SUMMARY

In a first aspect, there is provided a leaky-wave antenna comprising: a substrate extending along an axis, and a dielectric waveguide extending along the axis and arranged in the substrate. The dielectric waveguide includes, at least, a top side, a bottom side, and opposite sides extending generally along the axis and between the top and bottom sides. A distance defined between the opposite sides varies along the axis for at least part of a length of the dielectric waveguide. The length of the dielectric waveguide extends in a direction collinear with or parallel to the axis. For example, the distance defined varies along the axis for 50%, 60%, 70%, 80%, or 90% of the length of the dielectric waveguide. The antenna is RF antenna. In one example, the axis along with the substrate extend is the central axis of the substrate. In another example, the axis along with the substrate extend is not the central axis of the substrate. In one example, the axis along with the substrate extend is a long axis of the substrate. In one example, the axis along with the substrate extend is not a long axis of the substrate (e.g., the substrate need not be elongated).

Optionally, the dielectric waveguide is arranged within the substrate.

Optionally, the opposite sides are generally symmetric about the axis.

Optionally, the distance defined between the opposite sides repeatedly increases and decreases along the axis for at least part of a length of the dielectric waveguide.

Optionally, the distance defined between the opposite sides varies sinusoidally along the axis for at least part of a length of the dielectric waveguide. As used herein, "sinusoidally" does not require a strict sine relationship, and can cover any relationship having the form of any part(s) of a sine curve or function, e.g., a cosine relationship.

Optionally, the distance defined between the opposite sides varies sinusoidally with changing frequency along the axis for at least part of a length of the dielectric waveguide. The changing frequency may be generally increasing frequency, monotonically increasing frequency, generally decreasing frequency, monotonically decreasing frequency, etc. As used herein, generally increasing and generally decreasing refer to an increasing trend and a decreasing trend respectively and do not require strict monotonic increase and decrease.

Optionally, the substrate is a dielectric substrate. Optionally the same dielectric material is used for the substrate and the dielectric waveguide.

Optionally, the dielectric waveguide is integrated with the substrate, and the substrate comprises a plurality of metallic vias (e.g., via holes) arranged in, at least, two rows that extend generally along or parallel to the axis to delimit or define the opposite sides of the dielectric waveguide.

Optionally, the leaky-wave antenna further comprises a metallic arrangement (e.g., metallic layer(s)) arranged on a top surface of the substrate, and a ground plane arranged on a bottom surface of the substrate.

Optionally, the metallic arrangement, or metallic layer(s), defines a groove corresponding to the top side of the dielectric waveguide such that the metallic layer does not cover the top side of the dielectric waveguide. The groove may be an etched groove, i.e., formed by etching of the metallic arrangement.

Optionally, the dielectric waveguide has a generally constant thickness defined between the top and bottom sides. Optionally, the dielectric waveguide has a generally constant dielectric thickness and/or surface impedance.

Optionally, the substrate has a generally constant thickness.

Optionally, the thickness of the dielectric waveguide is smaller than the thickness of the substrate.

Optionally, the thickness of the dielectric waveguide is the same as the thickness of the substrate.

Optionally, the substrate comprises a body defining a channel, and the dielectric waveguide is arranged inside or filled in the channel.

Optionally, the body is a metallic body.

Optionally, the leaky-wave antenna further comprises a transition arrangement arranged to operate as an impedance transformer for insertion into another waveguide to excite a fundamental mode of the dielectric waveguide.

Optionally, the transition arrangement is directly connected with the substrate.

Optionally, the transition arrangement is integrally formed with the dielectric waveguide.

Optionally, the transition arrangement is integrally formed with the substrate.

Optionally, the transition arrangement comprises a tapered transition that tapers along the axis away from the substrate.

Optionally, the transition arrangement comprises a trapezoidal portion that tapers along the axis away from the substrate and a rectangular portion arranged between (e.g., connected directly between) the trapezoidal portion and the dielectric waveguide.

Optionally, the dielectric waveguide is an additively manufactured dielectric waveguide. For example, the dielectric waveguide can be produced using additive manufacturing machines (e.g., 3D printer).

Optionally, the leaky-wave antenna is arranged to operate in microwave and millimeter-wave bands. In some embodiments, the leaky-wave antenna may operate is other frequency or wave bands.

Optionally, the leaky-wave antenna is operable for far-field high-gain applications.

Optionally, the leaky-wave antenna is operable for near-field focusing applications.

Optionally, the substrate is a PCB substrate. The substrate may be a one-layer PCB substrate or a multi-layer PCB substrate.

In a second aspect, there is provided an electrical device comprising one or more leaky-wave antennas of the first aspect. The electrical device may be a communication device, a radar device, a non-contact sensing device, an RFID device, a millimeter-wave imaging device, and a wireless energy transmission device, etc. The communication device may be a wireless communication device. The communication device may be a cellular (5G, 6G, or higher)

communication device. The communication device may be a phone, a laptop, a smart watch, a computer, an IoT device, etc.

In a third aspect, there is provided an electrical system comprising one or more leaky-wave antennas of the first aspect. The electrical system may be a communication system, a radar system, a non-contact sensing system, an RFID system, a millimeter-wave imaging system, and a wireless energy transmission system, etc. The communication system may be a wireless communication system. The communication system may be a cellular (5G, 6G, or higher) communication system. The communication system may be a computer system, an IoT system, etc.

In a fourth aspect, there is provided a method for manufacturing a leaky-wave antenna. The method comprises manufacturing a dielectric waveguide that includes, at least, a top side, a bottom side, and opposite sides extending generally along the axis and between the top and bottom sides. A distance defined between the opposite sides varies along the axis for at least part of a length of the dielectric waveguide. For example, the distance defined varies along the axis for 50%, 60%, 70%, 80%, or 90% of the length of the dielectric waveguide. The method also includes arranging the dielectric waveguide into, or filling the dielectric waveguide in, a channel defined by a body of the substrate.

Optionally, the arranging may be performed substantially simultaneously as the manufacturing (e.g., the dielectric waveguide is manufactured in the channel).

Optionally, the manufacturing step may be performed using additive manufacturing means such as additive manufacturing machine (e.g., 3D printer).

Other features and aspects of the invention will become apparent by consideration of the detailed description and accompanying drawings. Any feature(s) described herein in relation to one aspect or embodiment may be combined with any other feature(s) described herein in relation to any other aspect or embodiment as appropriate and applicable.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Embodiments of the invention will now be described, by way of example, with reference to the accompanying drawings in which.

DETAILED DESCRIPTION

Figure 1A:
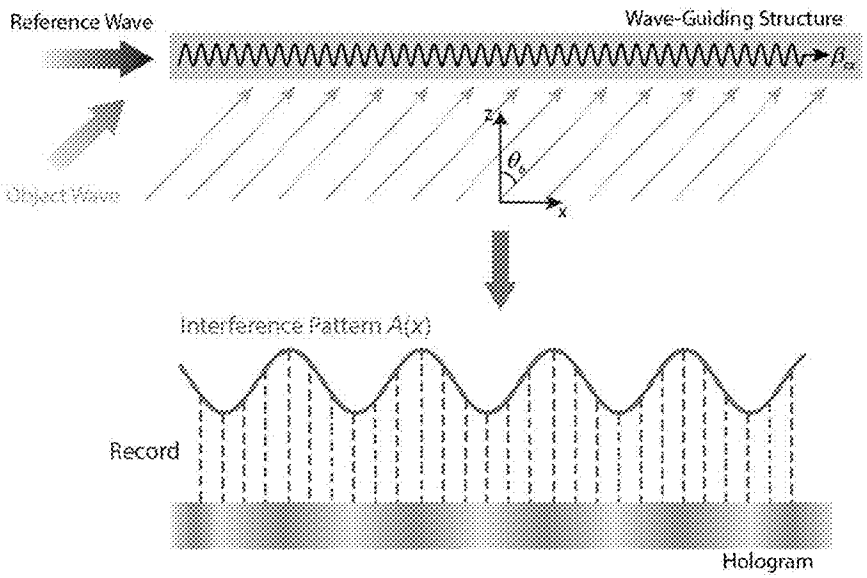
FIG. 1A is a schematic diagram illustrating a recording process of a conceptual holographic amplitude-modulated leaky-wave antenna.

The inventors of the present application have devised, through research, experiments, and/or trials, that the holography concept originating from optics or optical theory can be extended or applied to the RF band to offer new potential for antenna design, and that surface wave-fed holographic antennas, i.e., holographic leaky-wave antennas, are advantageous as they have relatively simple feeding and antenna structures. In this disclosure, the inventors use classical optical holographic theory to interpret the physical mechanism of leaky-wave antennas to enable novel leaky-wave antennas design. Preferably, the leaky-wave antennas are amplitude-modulated leaky-wave antennas.

Holographic Amplitude-Modulated Leaky-Wave Antenna Theory

In amplitude-modulated leaky-wave antennas, such as those disclosed in Wu et al., "*Amplitude-Modulated (AM) Leaky-Wave Antennas*," in *IEEE Transactions on Antennas and Propagation*, doi: 10.1109/TAP.2020.3044673, the magnitude of the carrier wave is spatially modulated to generate the modulated waves with desired radiation characteristics. For example, Wu has demonstrated that sinusoidal modulation of the amplitude of the slow carrier wave can generate high-gain pencil beam. On the other hand, it is known that the antenna should provide a proper aperture amplitude and phase distribution corresponding to the desired far-field radiation pattern. Indeed, the aperture phase distribution of an antenna is important because it determines the propagation direction of radiating EM waves. However, amplitude-modulated leaky-wave antennas is a type of spatial amplitude-only modulation (without modulating the phase angle of the travelling wave). The aperture phase distribution of the amplitude-modulated leaky-wave antenna is a simple progressive phase front, which is similar or identical to that of the unmodulated wave-guiding structure. Therefore, it is important to understand how amplitude-modulated leaky-wave antennas, as an amplitude-only variation structure, could generate the desired object wave with both amplitude and phase information. This understanding can be facilitated by reference to the field of optics or optical theory.

For image recording in the optical field, the object wave that needs to be recorded contains both amplitude and phase information. The available recording media such as photographic emulsions, however, are only responsive to the intensity but insensitive to the phase of the light wave. Thus, there is a need to transform the phase information to amplitude variation for image recording. In this regard, GABOR, D. *A New Microscopic Principle. Nature* 161, 777-778 (1948). https://doi.org/10.1038/161777a0 has proposed a seminal imaging process, known as holography, to convert the phase information of waves into intensity variations. The holography technology uses a known reference wave $E_r$ to interfere with the desired object wave $E_o$ and photographically record only the amplitude information of their interference pattern (i.e., hologram) in the recording material. In this manner, the amplitude-only hologram carries both the information of amplitude and phase of the object wave $E_o$. By simply again illuminating the hologram with the reference wave, the recorded information in the amplitude-only hologram can be decoded and the object wave can be reconstructed.

The following further explains how the above-mentioned complex amplitude information carrying problem for amplitude-modulated leaky-wave antennas could be addressed based on the classical holographic theory. The holography generally involves two processes: recording and reconstruction.

First, consider the recoding process in holography. Suppose a one-dimensional (1D) amplitude-modulated leaky-wave antenna is designed to generate a far-field high-gain beam with a radiation angle $\theta_b$ with respect to the broadside direction as shown in FIG. 1A. The corresponding object wave in this case is a plane wave and the object wave can be expressed as:

$$E_o=A_o \exp[-j(k_0 \sin \theta_b x+k_0 \cos \theta_b z)] \tag{1}$$

where $A_o$ is the amplitude constant and $k_o$ is the free-space wavenumber. The unmodulated slow surface wave along the wave-guiding structure is used as the reference wave, which can be expressed as:

$$E_r=A_r \exp(-j\beta_{cx}x) \tag{2}$$

where $A_r$ is a positive constant for a uniform traveling-wave structure. Here, a slow-wave transmission line is assumed thus $\beta_{cx}>k_o$.

In analogy to the Gabor hologram, it is the intensity of the interference pattern between the object wave and reference wave in the antenna aperture plane (i.e., z=0 plane) that is somehow recorded in the wave-guiding structure. For example, as disclosed in Wu, the magnitude of the intensity interference pattern can be recorded in the spoof surface plasmon polariton (SPP) transmission line by varying the lateral width of the corrugation to change the aperture amplitude distribution. The amplitude variation/envelop of the travelling wave along the wave-guiding structure or hologram can be expressed as:

$$A(x)=|E_o+E_r|^2=|E_o|^2+|E_r|^2+E_r^*+E_o+E_rE_o^* \tag{3}$$

By substituting Equation (1) and Equation (2) into Equation (3), the following can be obtained:

$$A(x)=A_o^2+A_r^2+2A_rA_o \cos[\arg(E_r)-\arg(E_o)]=A_o^2+A_r^2+2A_rA_o \cos(\beta_{cx}x-k_0 \sin \theta_b x) \tag{4}$$

In this Equation (4), the first two terms on the right-hand side depend only on the intensities of the individual waves, and the third term depends on their relative phase. Although the intensity of interference pattern A(x) is a positive real number, the complete information involving both the amplitude $A_r$ and phase information $-\beta_{cx}x$ of the object wave $E_o$ is coded in the third term of Equation (4). In this manner, the phase information of the object wave is converted into the amplitude variation, and thus can be stored in the amplitude-modulated-only wave-guiding structure.

Figure 1B:
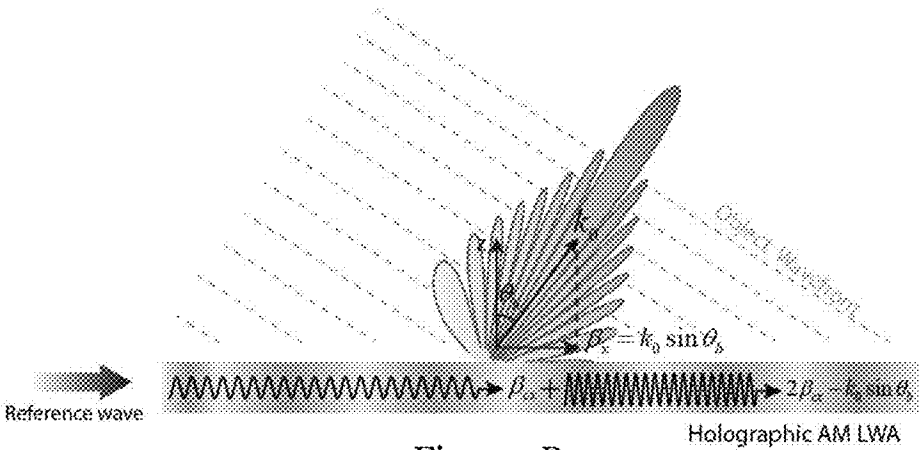
FIG. 1B is a schematic diagram illustrating a reconstruction process of a conceptual holographic amplitude-modulated leaky-wave antenna.

Next, consider the reconstruction process in holography. Once the information is recorded into the amplitude-modulated hologram, the next process is to reconstruct the object wave by again exciting the reference wave to the amplitude-modulated hologram as shown in FIG. 1B. The total generated wave in the amplitude-modulated hologram in the z=0 plane can be expressed as:

$$\begin{aligned} E_t &= A(x)E_r \\ &= (|E_o|^2+|E_r|^2)E_r+|E_r|^2E_o+E_r^2E_o^* \\ &= (A_o^2+A_r^2)A_r\exp(-j\beta_{cx}x)+A_r^2A_o\exp(-jk_0\sin\theta_b x)+ \\ &\quad A_r^2A_o\exp\{-j[(2\beta_{cx}-k_0\sin\theta_b)x]\} \end{aligned} \tag{5}$$

In this Equation (5), the first term on the right-hand side presents the reference wave multiplied by the sum of the intensities of the two waves. Since a slow-wave transmission is assumed (i.e., $\beta_{cx}>k_0$), the first term is a bounded surface wave propagating along the wave-guiding structure. The second term is the desired reconstructed wave consisting of the object wave multiplied by the intensity of the reference wave. The third term on the right-hand side of Equation (5) is a conjugated version of the object wave.

Since its propagating wavenumber $2\beta_{cx}-k_0 \sin \theta_b > 2k_0-k_0 \sin \theta_b > k_0$, the third conjugated term is also a non-radiating bounded mode. As a result, although three types of wave are generated by exciting the amplitude-modulated hologram, only the desired reconstructed object wave is fast wave and radiating into free space, while the other two residual waves are slow waves without contributing to the far-field radiation as shown in FIG. 1B. In this manner, the amplitude-modulated hologram work as a high-gain amplitude-modulated leaky-wave antenna.

Similar to the classic optical Gabor hologram, the amplitude-modulated leaky-wave antenna records the intensity of the interferogram pertinent to both the amplitude and phase of the object wave. As a result, even it is a type of amplitude-only modulation, amplitude-modulated leaky-wave antennas can still generate both the desired aperture amplitude and phase distributions of the object wave. However, unlike the optical Gabor hologram, amplitude-modulated leaky-wave antennas use the surface wave, not the space wave, as the reference wave. On the other hand, Gabor holograms may suffer from the limitation of twin-image problem, i.e., overlapping the desired object wave with the conjugated object wave. Fortunately, this is not a problem for amplitude-modulated leaky-wave antennas because the conjugated object wave in the third term of Equation (5) is a bounded surface wave and only the object wave can be radiated into free space.

With a basic understanding of the above, the following disclosure relates to unified holographic theory and spatial spectrum analysis. The concept of amplitude-modulated leaky-wave antenna originates from the amplitude modulation technique in classical communications theory. The spatial Fourier transform is generally adopted to analyze the spatial frequency spectrum of the amplitude-modulated leaky-wave antennas. In this disclosure, the amplitude-modulated leaky-wave antenna is treated as an amplitude-recording hologram based on the classical holographic theory. The consistency between these two theories is further demonstrated as follows.

For the recording process, the intensity of the interference pattern in Equation (4) can be reorganized as:

$$A(x) = \left(A_o^2 + A_r^2\right)\left[1 + \frac{2A_rA_o}{A_o^2 + A_r^2}\cos(\beta_{cx}x - k_0\sin\theta_b x)\right] = A_c\left[1 + M\cos\left(\frac{2\pi}{\Lambda}x\right)\right] \tag{6}$$

where M ($0<M<1$) is the modulation index, and $\Lambda$ is the periodicity of the sinusoidal modulating wave, and:

$$A_c = A_o^2 + A_r^2 \tag{7}$$

$$M = \frac{2A_rA_o}{A_o^2 + A_r^2} \tag{8}$$

$$\frac{2\pi}{\Lambda} = \beta_{cs} - k_0\sin\theta_b \tag{9}$$

It can be seen from Equation (6) that the intensity of the interference pattern of the two waves can be written in the form of sinusoidal amplitude modulation—consistent with the finding in Wu that a sinusoidally amplitude-modulated leaky-wave antenna can generate a high-gain pencil beam.

From the perspective of spatial spectrum analysis based on Fourier transform, the amplitude-modulated leaky-wave antenna is interpreted as a waveform modulator to shift the spatial spectrum of the modulating wave up to the carrier spatial frequency. The free space acts as a spatial band-pass filter which only allows the spatial spectrum fallen within the visible region to radiate. A sinusoidal amplitude variation is required in order to generate the desired spatial frequency impulse. The developed holographic theory in this disclosure provides a different physical interpretation of amplitude-modulated leaky-wave antennas. The reason that a sinusoidal amplitude modulation is required to generate a high-gain beam is due to the fact that the intensity of the interference pattern between the slow reference wave and the object plane wave is a sinusoidal distribution, as depicted in FIG. 1A.

For the reconstruction process, by substituting Equations (7) to (9) into Equation (5), the total reconstructed wave can be expressed as:

$$E_t = A_cA_r \left\{\exp(-j\beta_{cx}x) + \frac{M}{2}\exp\left[-j\left(\beta_{cx} - \frac{2\pi}{\Lambda}\right)x\right] + \frac{M}{2}\exp\left[-j\left(\beta_{cx} + \frac{2\pi}{\Lambda}\right)x\right]\right\} \tag{10}$$

It can be seen that three reconstructed waves in Equation (5) based on the holographic theory actually correspond to three spatial frequency impulses $$\beta_{cx},\ \beta_{cx} - \frac{2\pi}{\Lambda},\ \text{and}\ \beta_{cx} + \frac{2\pi}{\Lambda},$$

based on the spatial frequency spectrum analysis. The desired object wave corresponds to the lower spatial frequency impulse $$\beta_{cx} - \frac{2\pi}{\Lambda},$$

which is the only wave component that is within the visible region and can be radiated into free space.

Far-Field Holographic Amplitude-Modulated Leaky-Wave Antenna

Inset dielectric waveguide, i.e., a substrate with a rectangular groove filled with dielectric, may be used as a transmission line for millimeter wave frequencies owing to its advantageous properties such as low propagation loss and relatively easy fabrication. Furthermore, substrate integrated inset dielectric waveguide, as a type of substrate integrated circuits, can be easily implemented using standard PCB process and integrated with circuits. The amplitude-modulated holographic theory presented above provides a new way to realize inset dielectric waveguide-based leaky-wave antennas.

Figure 2A:
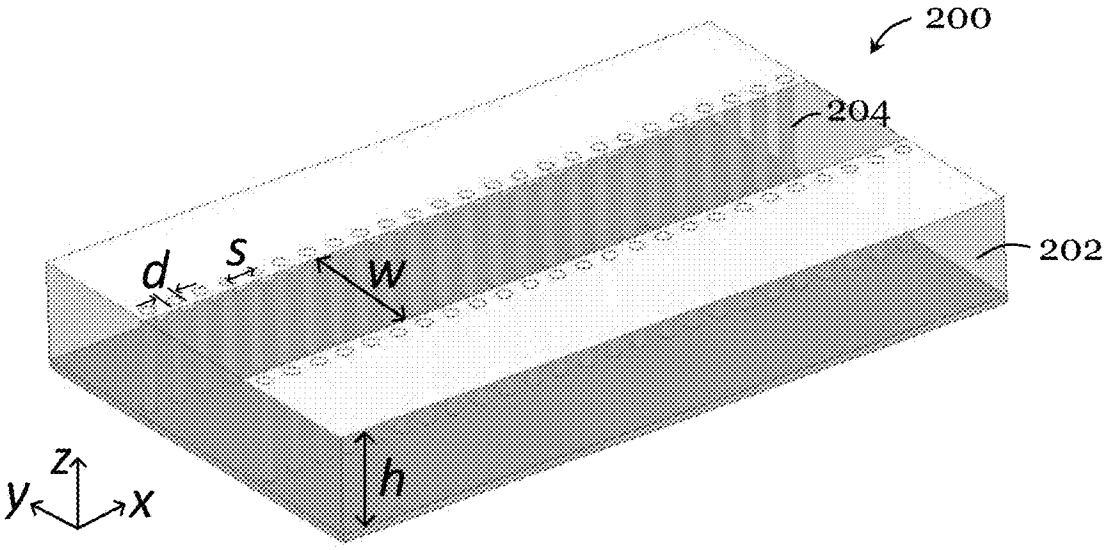
FIG. 2A is a schematic diagram of a uniform substrate integrated inset dielectric waveguide.
Figure 2B:
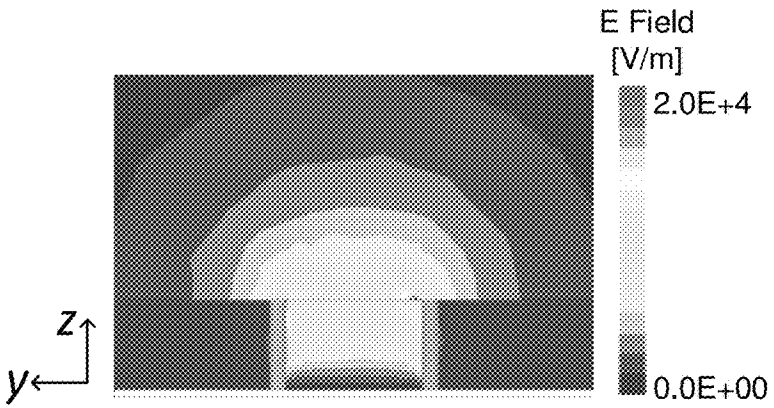
FIG. 2B is a plot showing simulated magnitude distribution of the fundamental $TE_{01}$ mode of the substrate integrated inset dielectric waveguide of FIG. 2A in the transversal plane (yz-plane)
Figure 2C:
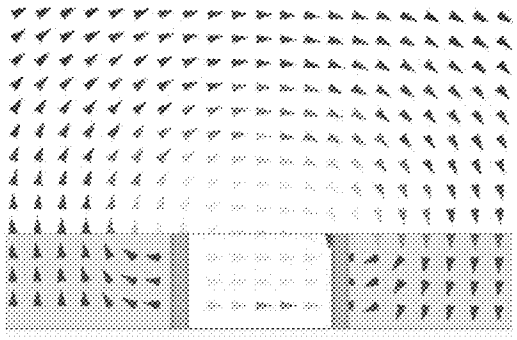
FIG. 2C is a plot showing simulated vector distribution of the fundamental $TE_{01}$ mode of the substrate integrated inset dielectric waveguide of FIG. 2A in the transversal plane (yz-plane)

FIG. 2A shows the configuration of a uniform substrate integrated inset dielectric waveguide 200. The waveguide 200 includes a substrate 202 and two linear rows of the metallic vias 204 (or via holes) arranged in the substrate. The rows of metallic vias 204 act as vertical walls to realize a rectangular inset dielectric waveguide in planar form. In this example, the diameter d and spacing of the metallic via holes s are 0.3 and 0.5 mm, respectively. The width of the dielectric aperture is defined as w and the thickness of the substrate is defined as h. In this example, the substrate used is Rogers 5880 with a relative permittivity of 2.2. In this example, the fundamental mode of the substrate integrated inset dielectric waveguide 200 is $TE_{01}$ mode. FIGS. 2B and 2C show simulated magnitude and vector distributions of the fundamental $TE_{01}$ mode of the substrate integrated inset dielectric waveguide 200 in the transversal plane (yz-plane). As shown in the E-field distribution in the transversal plane in FIGS. 2B and 2C, the energy is mainly confined in the substrate and inset dielectric waveguide aperture.

Figure 3B:
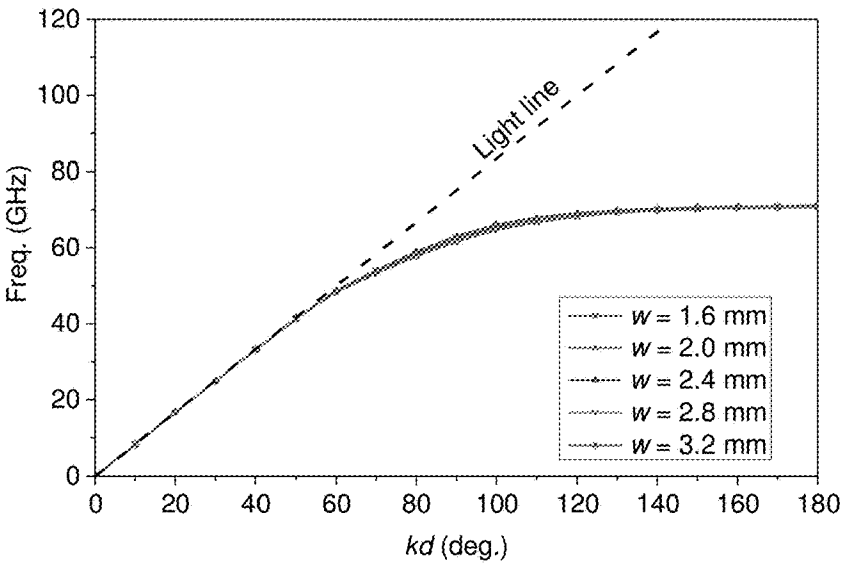
FIG. 3B is a dispersion diagram of the substrate integrated inset dielectric waveguide of FIG. 2A of different values of aperture width w.
Figure 3A:
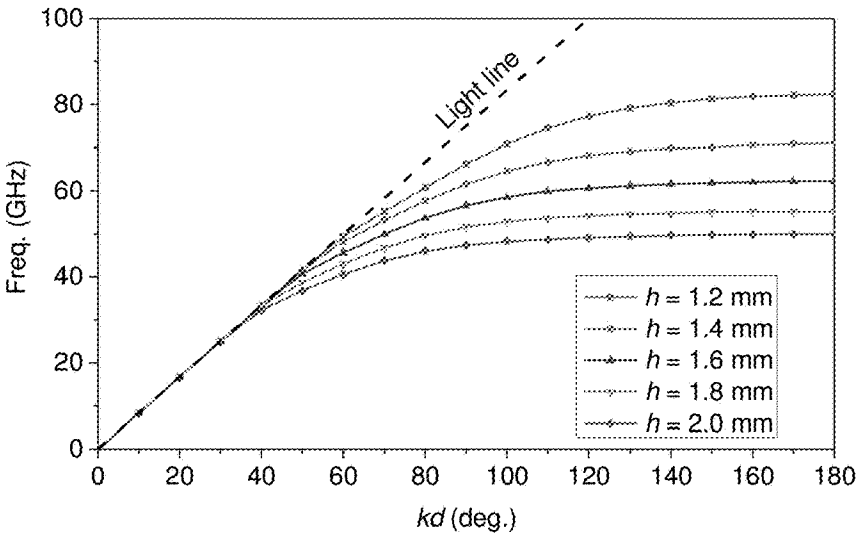
FIG. 3A is a dispersion diagram of the substrate integrated inset dielectric waveguide of FIG. 2A of different values of substrate thickness h.

FIGS. 3A and 3B show the dispersion curves of the substrate integrated inset dielectric waveguide 200 with different values of dielectric thickness h and aperture width w simulated using the eigenmode solver of ANSYS HFSS. From FIGS. 3A and 3B, it can be seen that the dispersion curves are in slow-wave region and hence the wave is bounded and propagating along the inset dielectric waveguide transmission line. Furthermore, the dispersion relation is mainly affected by the dielectric thickness h while insensitive to the aperture width w. Nevertheless, the field intensity of the substrate integrated inset dielectric waveguide will increase when the aperture width is reduced due to the compressed field in the transversal plane (yz-plane). As a result, the magnitude of the guided wave on the substrate integrated inset dielectric waveguide can be modulated by simply varying the aperture width w without changing the surface impedance.

In this example, the dielectric thickness of the inset dielectric waveguide and the surface impedance are kept substantially constant respectively and the aperture width w is varied to realize the sinusoidal amplitude distribution. The planar substrate integrated inset dielectric waveguide arrangement can be realized using the standard PCB fabrication. It should be noted that the operating mechanism of the inset dielectric waveguide-based leaky-wave antenna based on amplitude-modulated holographic theory here is fundamentally different from that of SMRS/MTS antennas because for the inset dielectric waveguide-based leaky-wave antenna, the surface impedance is generally uniform along the transmission line. The physical mechanism for the complete recording of object wave in the aperture magnitude variation can be regarded in a fashion analogous to that for the optical Gabor hologram. In fact, describing the interferogram by the aperture magnitude variation is more intuitive compared to the surface impedance because this is exactly what the optical holograms adopt.

Figure 4:
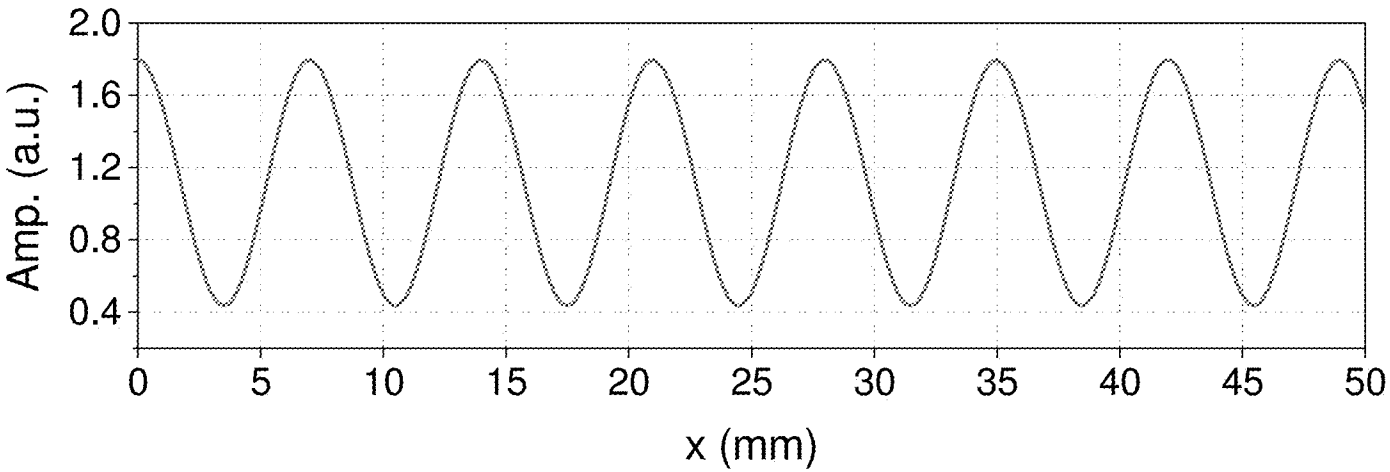
FIG. 4 is a graph showing intensity distribution of the interferogram between the object and reference plane waves for high-gain pencil beam generation.

An amplitude-modulated leaky-wave antenna can be designed using the holographic amplitude-modulated theory presented above. In one example, the thickness of the substrate is 1.4 mm, which consists of two Rogers 5880 substrates with thickness of 0.508 and 0.787 mm bonded by a 0.1 mm-thick Rogers 4450F bonding film. The normalized propagation wavenumber of the travelling wave in the substrate integrated inset dielectric waveguide, i.e., reference wave, is $\beta_{cx}/k_0=1.23$ at 55 GHz based on the dispersion curve in FIG. 3. The intended main beam direction of the holographic amplitude-modulated leaky-wave antenna is 27° at 55 GHz. The intensity of the interferogram between the object and reference waves can be determined by Equation (4) with the parameters of $A_r=1$ and $A_o=0.34$. FIG. 4 shows intensity distribution of the interferogram between the object and reference plane waves for high-gain pencil beam generation. A sinusoidal magnitude distribution can be observed in FIG. 4. The aperture width w of the substrate integrated inset dielectric waveguide can be tuned accordingly to record the intensity of the interferogram in FIG. 4.

Figure 5:
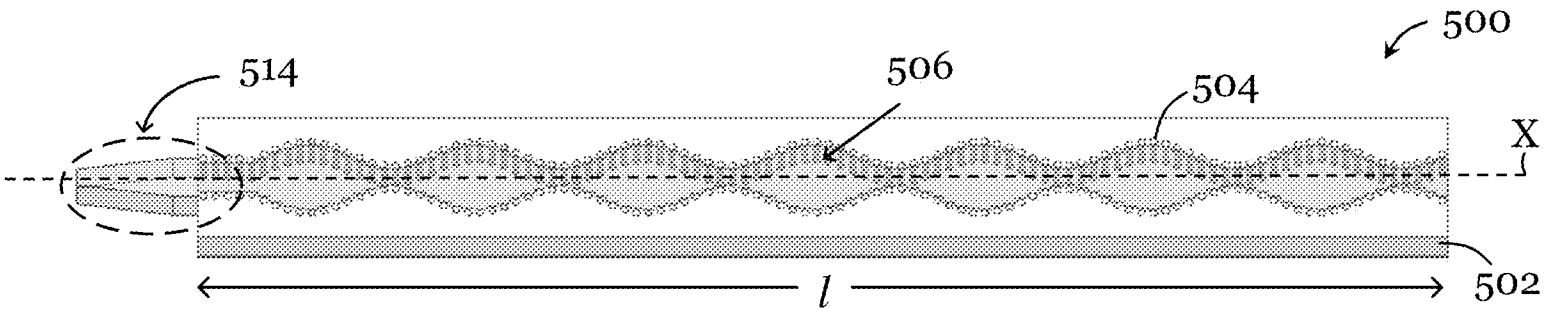
FIG. 5 is a schematic diagram of a leaky-wave antenna in one embodiment of the invention.
Figures 5A, 5B, 5C:
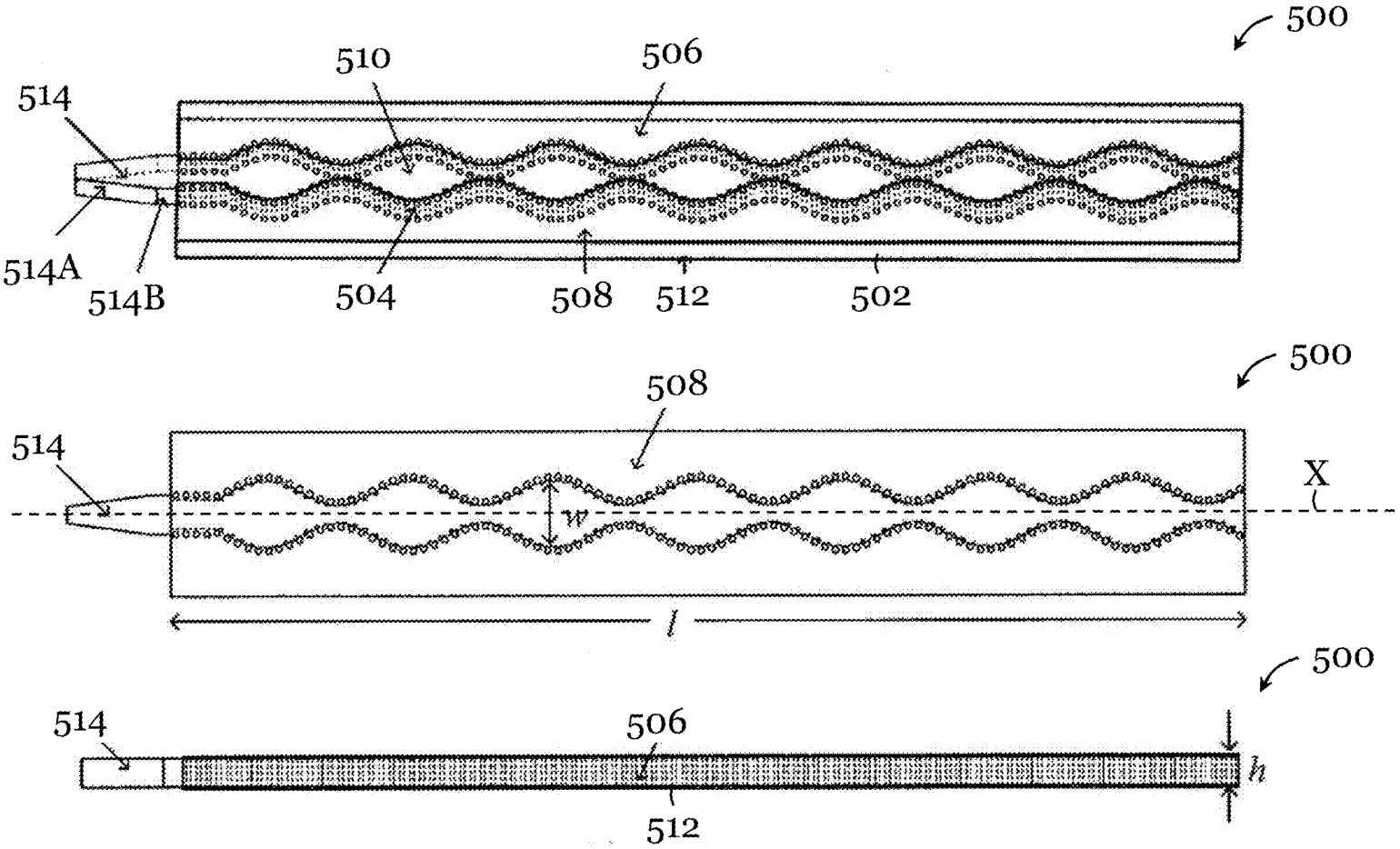
FIG. 5A is another schematic diagram of the leaky-wave antenna of FIG. 5.
FIG. 5B is a top view of the leaky-wave antenna of FIG. 5.
FIG. 5C is a side view of the leaky-wave antenna of FIG. 5.

FIGS. 5 to 5C show an amplitude-modulated leaky-wave antenna 500 in one embodiment of the invention. The leaky-wave antenna 500 is a holographic amplitude-modulated leaky-wave antenna based on the substrate integrated inset dielectric waveguide. The leaky-wave antenna 500 is particularly suited for far-field high-gain applications.

As shown in FIGS. 5 to 5C, the leaky-wave antenna 500 includes a substrate 502 extending along an axis X, and a dielectric waveguide 506 (transmission line) extending along the axis X and arranged in the substrate 502. The dielectric waveguide 506 includes a top side, a bottom side, and opposite sides extending generally along the axis X and between the top and bottom sides. The two opposite sides have a wavy contour such that distance defined between the opposite sides varies along the axis X. In this embodiment, the distance defined between the opposite sides varies sinusoidally, with a generally constant frequency, to realize the sinusoidal amplitude distribution along the dielectric waveguide 506 such that the n=−1 space harmonic becomes a fast wave and thereby radiates. In this embodiment, the dielectric waveguide 506 is integrated with the substrate 502 (e.g., the dielectric waveguide 506 and the substrate 502 are of the same dielectric material), and the substrate 502 comprises two rows of metallic vias 504 (e.g., via holes) that extend generally parallel to the axis X to delimit or define the opposite sides of the dielectric waveguide 506. The opposite sides of the dielectric waveguide 506 are generally symmetric about the axis X. As shown in FIG. 5A, a metallic layer 508 is arranged on the top surface of the substrate 502. A sinusoidal-modulated aperture pattern 510 with the lateral width w is etched in or on the metallic layer 508 such that the metallic layer 508 does not cover the top side of the dielectric waveguide 506. A ground plane 512 is arranged on a bottom surface of the substrate 502 to act as a one-sided shielding. In this example, the substrate 502 and the dielectric waveguide 506 both have a generally constant dielectric thickness, and the dielectric waveguide 506 has a generally constant surface impedance. The leaky-wave antenna 500 further comprises transition arrangement 514 arranged to operate as an impedance transformer for insertion into another waveguide to excite a fundamental mode (e.g., $TE_{01}$ mode) of the dielectric waveguide 502. In this embodiment, the transition arrangement 514 is directly connected with, e.g., integrally formed, the substrate 502. The transition arrangement 514 comprises a tapered/trapezoidal portion (dielectric substrate) 514A that tapers along the axis X away from the substrate and a rectangular portion (dielectric substrate) 514B connected directly between the trapezoidal portion 514A and the dielectric waveguide 506. In this embodiment, the leaky-wave antenna 500 can be implemented in or fabricated from a single-layer PCB substrate.

Figure 5D:
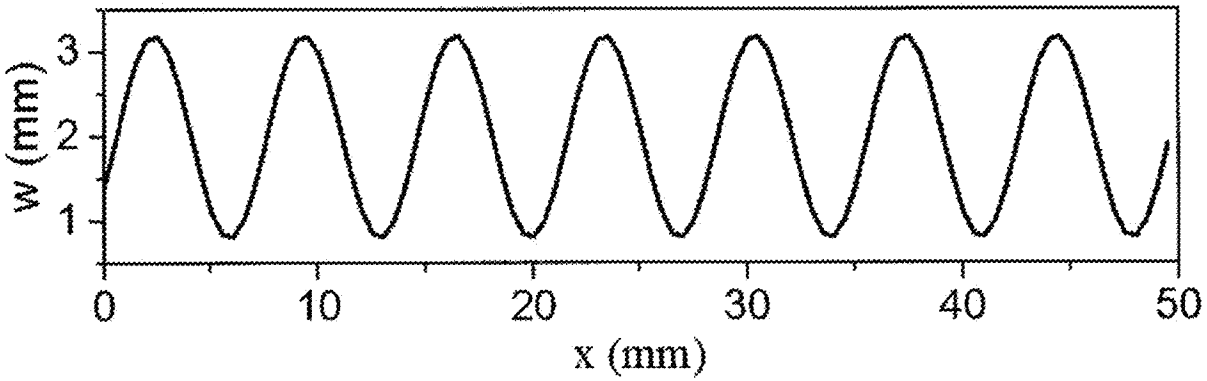
FIG. 5D is a graph showing aperture width distribution of the leaky-wave antenna of FIG. 5.

FIG. 5D shows the aperture width w distribution of the leaky-wave antenna 500 along axis X or the dielectric waveguide 506. In this embodiment, the aperture width w varies sinusoidally.

Figure 6B:
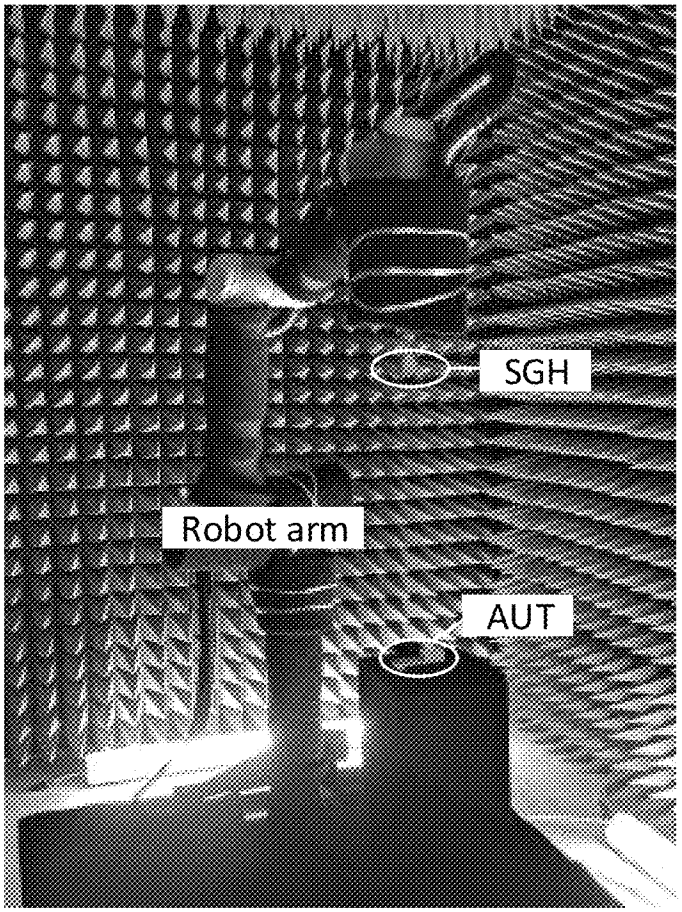
FIG. 6B is a photo of a measurement setup for testing the performance of the leaky-wave antenna of FIG. 6A.
Figure 6A:
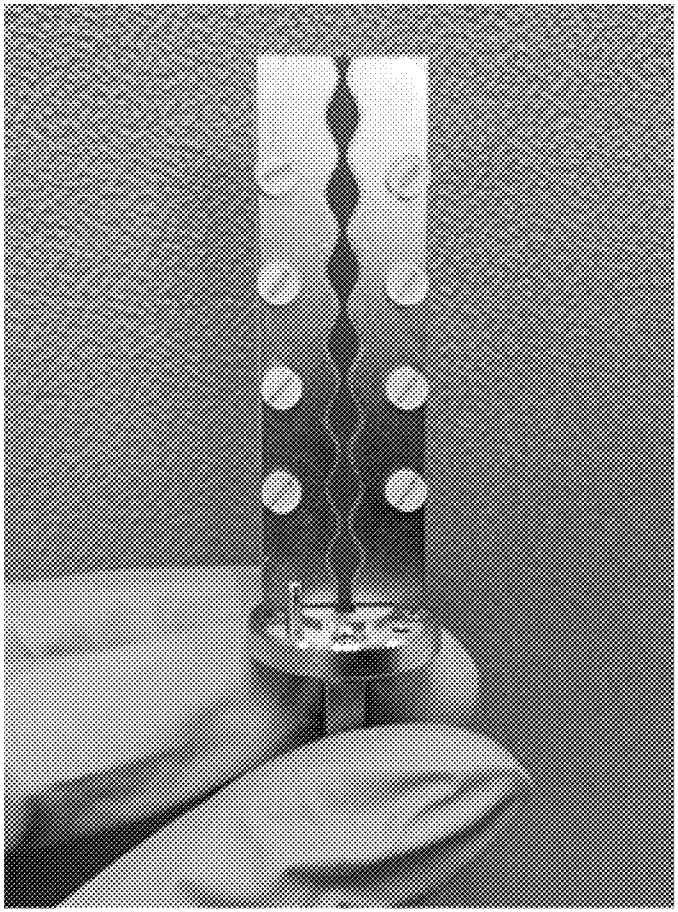
FIG. 6A is photo of a leaky-wave antenna fabricated based on the leaky-wave antenna of FIG. 5.

FIG. 6A shows a leaky-wave antenna 600 fabricated based on the leaky-wave antenna design 500 using standard PCB process. In this example, the holographic amplitude-modulated leaky-wave antenna 600 has a length of l=52 mm, with the relative permittivity of the substrate at 2.2 and the thickness of the substrate h at 1.4 mm. The antenna 600 can be excited by a standard rectangular waveguide (WR15). The tapered transition, acting as an impedance transformer, is directly inserted into the rectangular waveguide to excite the fundamental $TE_{01}$ mode of the substrate integrated inset dielectric waveguide. A waveguide is used as the feed here for testing purpose, a grounded coplanar waveguide (GCPW) can be used to excite the substrate integrated inset dielectric waveguide when integrating the holographic amplitude-modulated leaky-wave antenna with millimeter circuits.

FIG. 6B shows a measurement setup for testing the performance of the leaky-wave antenna 600. The leaky-wave antenna 600 was measured in such setup—a far-field/near-field reconfigurable robotic mmW antenna measurement system. In this setup, the antenna under test (AUT) is deployed as the transmitting antenna while a standard gain horn (SGH) (QWH-VPRR00) is used as the receiving antenna. The S-parameter of the antenna 600 was measured by a vector network analyzer (E8361A PAN Network Analyzer) using the setup in FIG. 6B.

Figure 7:
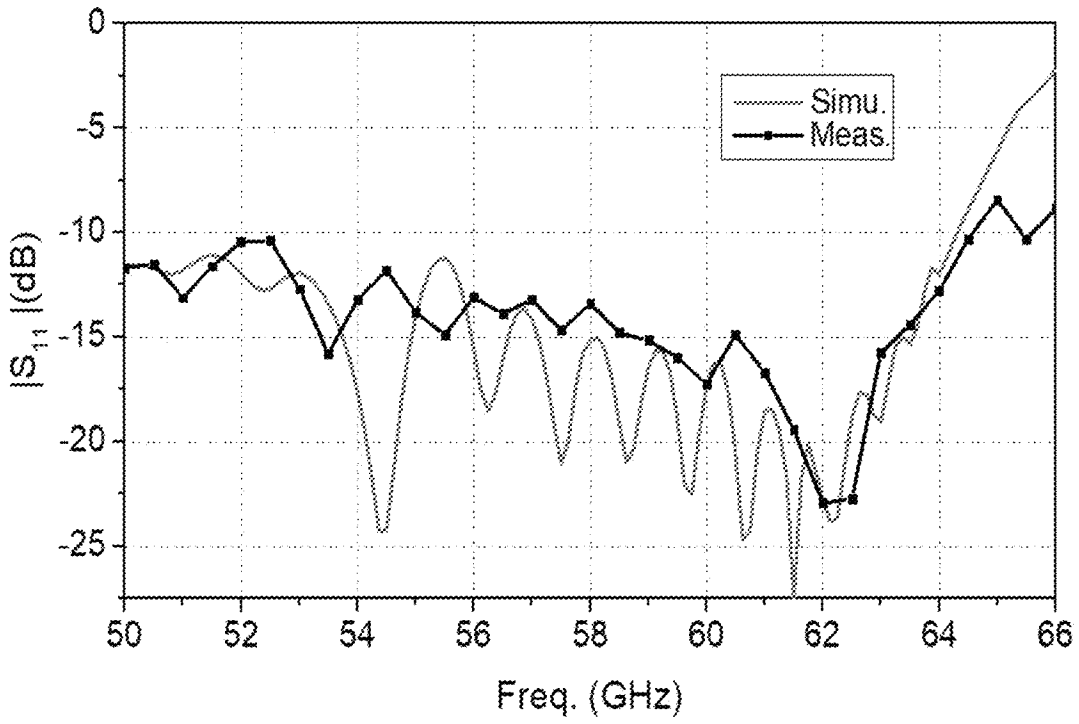
FIG. 7 is a graph showing simulated and measured $|S_{11}|$ value (dB) of the leaky-wave antenna of FIG. 6A for high-gain pencil beam applications at different frequencies.

FIG. 7 shows simulated and measured $|S_{11}|$ value (dB) of the leaky-wave antenna 600 for high-gain pencil beam applications at different frequencies. As shown in FIG. 7, the $|S_{11}|$ of the leaky-wave antenna 600 is smaller than −10 dB from 50 GHz to 64 GHz.

Figure 8:
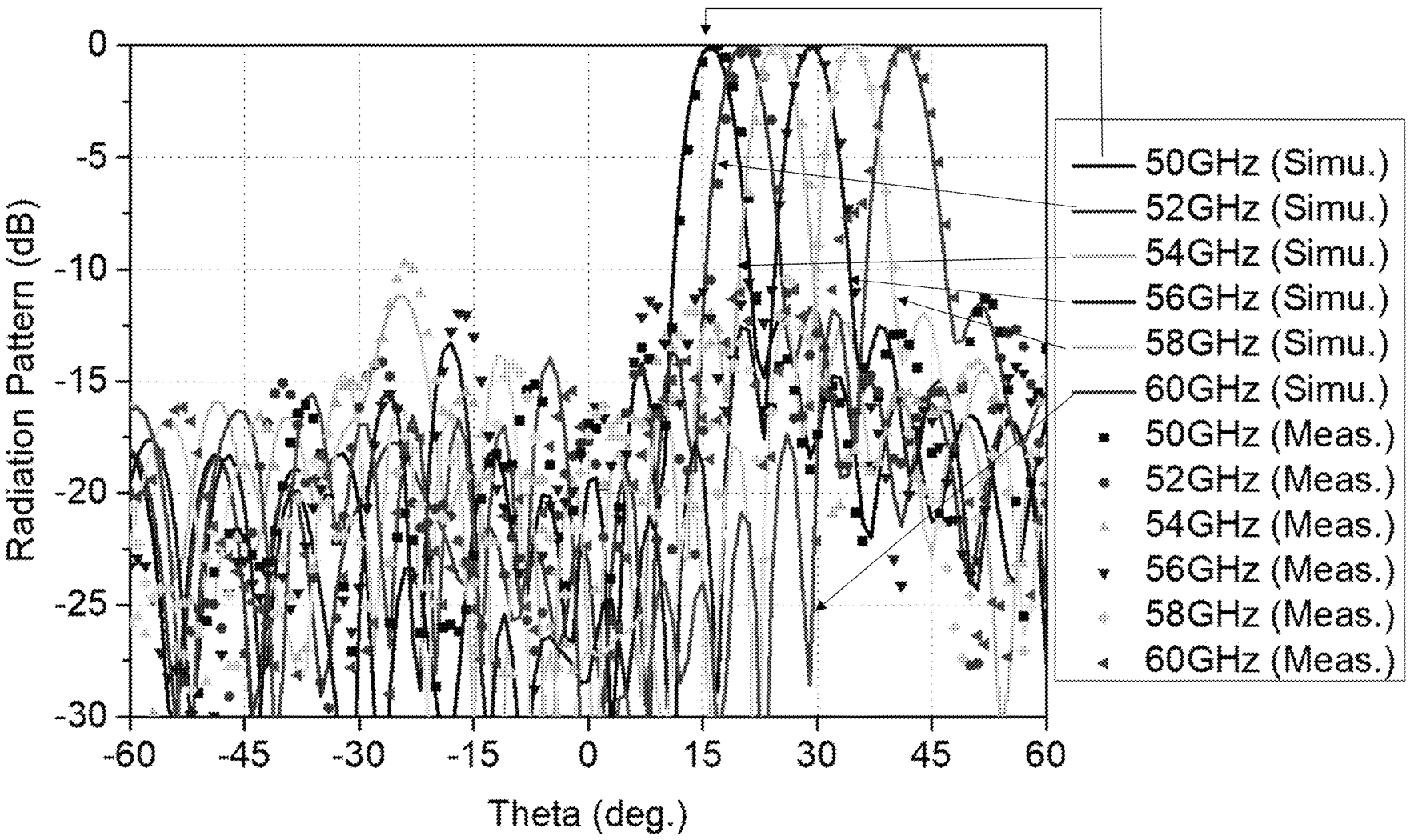
FIG. 8 is a graph showing simulated and measured normalized H-plane (xz-plane) radiation patterns of the leaky-wave antenna of FIG. 6A for high-gain pencil beam applications at different frequencies.

FIG. 8 shows simulated and measured normalized H-plane (xz-plane) radiation patterns of the leaky-wave antenna 600 for high-gain pencil beam applications at different frequencies. As illustrated in FIG. 8, pencil beam can be successfully generated by the leaky-wave antenna 600. Also, good agreement between the simulated and measured results can be observed.

Figure 9:
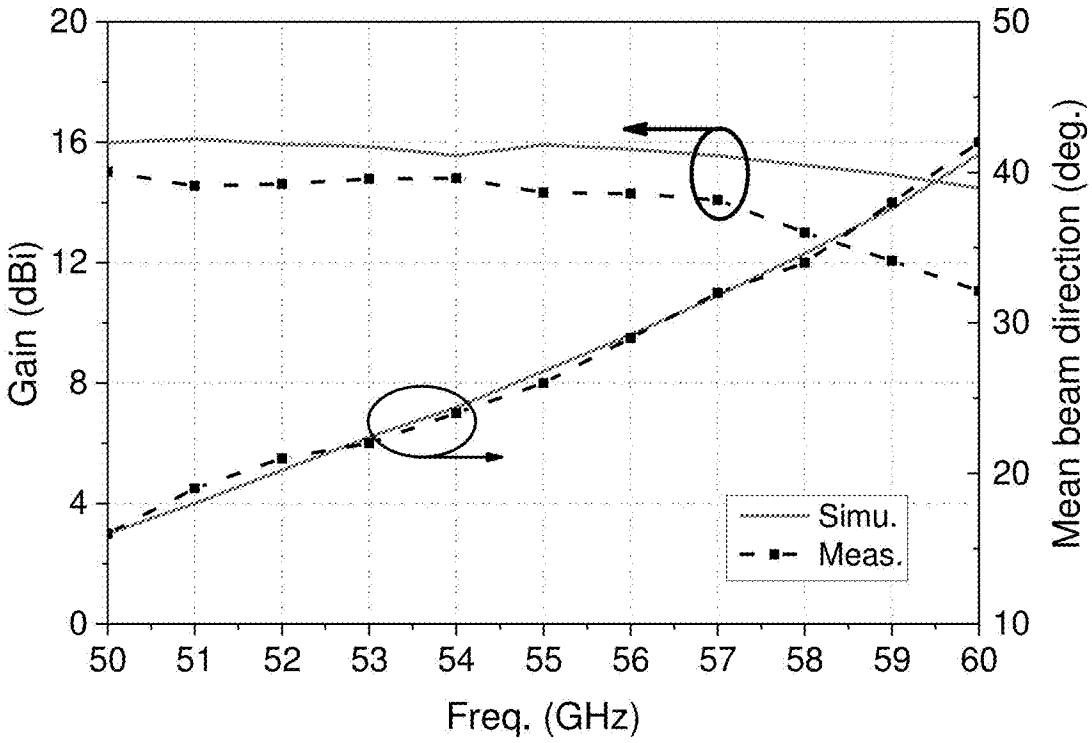
FIG. 9 is a graph showing simulated and measured gains and main beam direction of the leaky-wave antenna of FIG. 6A at different frequencies.

FIG. 9 shows simulated and measured gains and main beam directions of the leaky-wave antenna 600 at different frequencies. As shown in FIG. 9, the measured gain varies between 11-15 dBi from 50 GHz to 60 GHz. The measured gain is lower than the simulated gain by about 1.5 dB on average. This is primarily caused by the increased insertion loss of the substrate in mmW band and the fabrication error. The measured main beam angle is 26.50 at 55 GHz, agreeing well with the desired object wave direction of 27°. Both simulated and measured results show that the main beam direction of the leaky-wave antenna 600 can be scanned from 160 to 420 as the frequency varies from 50 GHz to 60 GHz. All these results demonstrate the effectiveness of the holographic theory to design the amplitude-modulated leaky-wave antenna 600.

Near-Field Focusing Holographic Amplitude-Modulated Leaky-Wave Antenna

Near-field focusing antenna can concentrate electromagnetic power into a small spot, thus can be useful in various applications, including noncontact sensing, RFID system, mmW imaging, and wireless transmission energy systems. Although both holographic theory and spatial frequency spectrum analysis can be used to design far-field amplitude-modulated leaky-wave antennas as demonstrated above and in Wu, the holographic theory in this disclosure provides a more intuitive approach to synthesize amplitude-modulated leaky-wave antennas for near-field focusing applications.

Figure 10B:
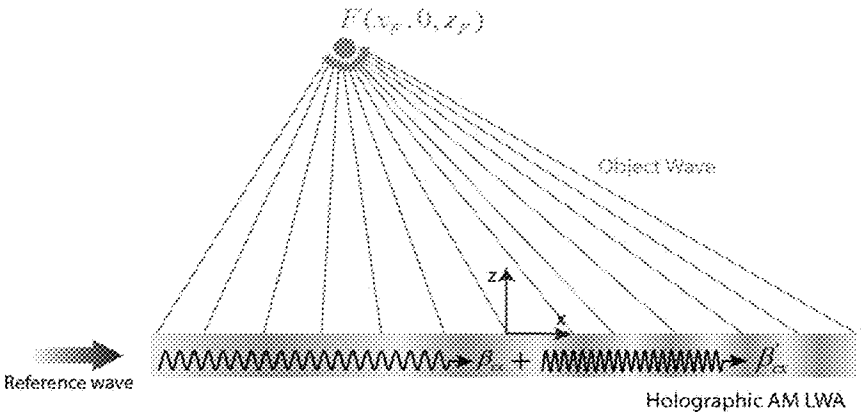
FIG. 10B is a schematic diagram illustrating a reconstruction process of a conceptual holographic amplitude-modulated leaky-wave antenna for near-field focusing applications.
Figure 10A:
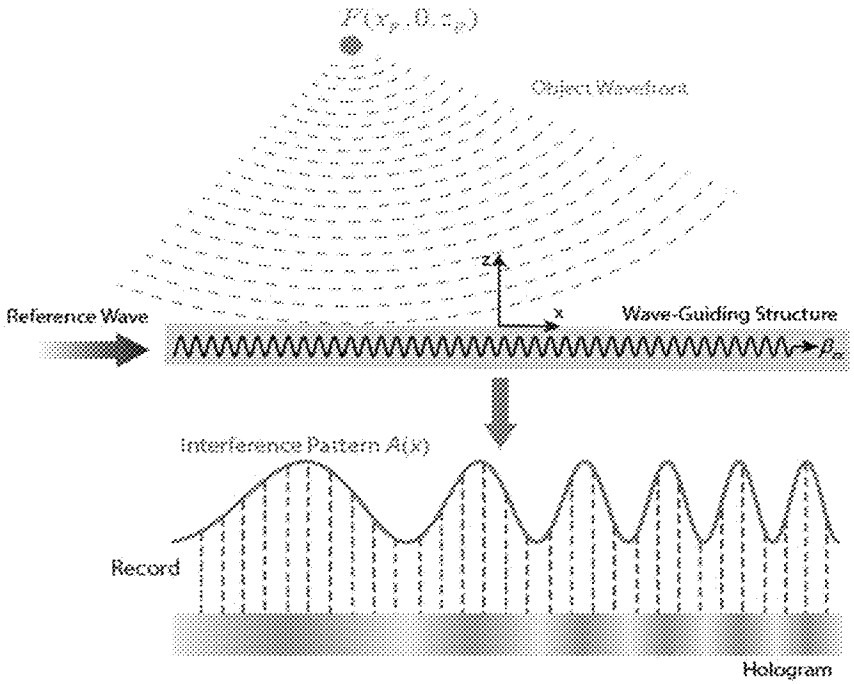
FIG. 10A is a schematic diagram illustrating a recording process of a conceptual holographic amplitude-modulated leaky-wave antenna for near-field focusing applications.

For the near-field focusing hologram, the object wave is a spherical wave converging to the focal point $F=(x_F, 0, z_F)$, as shown in FIG. 10A. The object wave can be expressed as:

$$E_o=A_o \exp(-jk_0\sqrt{(x-x_F)^2+(z-z_F)^2}) \tag{11}$$

The unmodulated slow travelling wave described by Equation (2) is again used as the reference wave. The amplitude-only wave-guiding hologram records the intensity of the interferogram between the object and reference waves, which can be obtained by substituting Equations (2) and (ii) into Equation (3). The result can be expressed as:

$$A(x)=A_o^2+A_r^2+2A_rA_o \cos[\beta_{cx}x+k_0\sqrt{(x-x_F)^2+z_F^2}] \tag{12}$$

For verification purpose, assume the substrate integrated inset dielectric waveguide is used as the amplitude-modulated hologram to focus the energy at the focal point F ($x_F$=−10 mm, $y_F$=0, $z_F$=40 mm) at 55 GHz.

Figure 11:
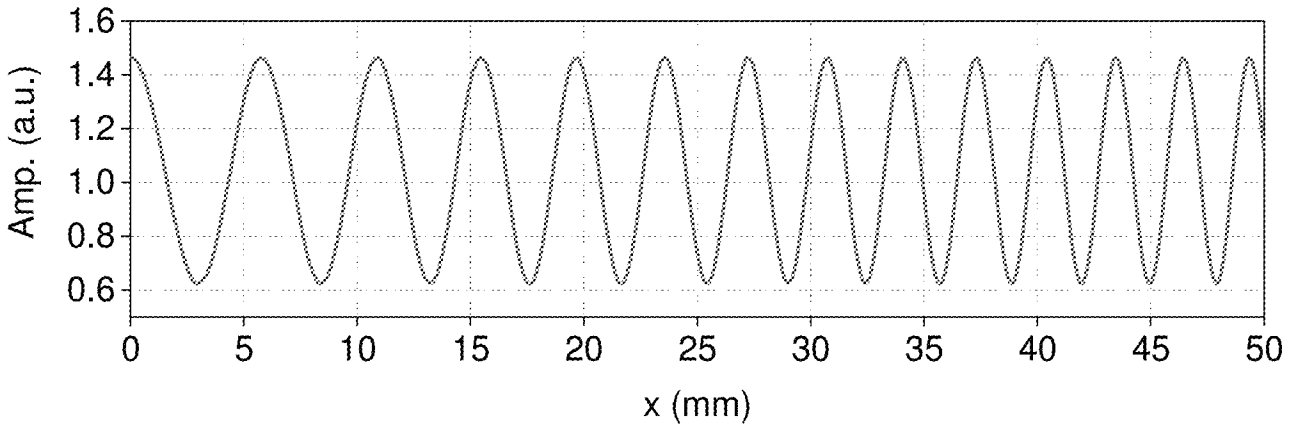
FIG. 11 is a graph showing intensity distribution of the interferogram between the object and reference plane waves for near-field focusing applications.

FIG. 11 shows intensity distribution of the interferogram between the object and reference plane waves for near-field focusing applications. The calculated result of the amplitude distribution of the amplitude-modulated hologram using Equation (12) is shown in FIG. 11 with the parameters of $A_r$=1, $A_o$=0.21. As shown in FIG. 11, there is a larger modulation period at the beginning and the period gradually decreases (frequency gradually increases) along the substrate integrated inset dielectric waveguide transmission line.

For the reconstruction process, the reference wave is again used to excite the amplitude-only hologram, as shown in FIG. 10B. The overall reconstructed wave can be written as:

$$\begin{aligned} E_t &= A(x)E_r \\ &= (A_o^2+A_r^2)A\exp(-j\beta_{sw}x)+A_r^2A_0\exp\left(-jk_0\sqrt{(x-x_F)^2+z_F^2}\right)+ \\ &\quad A_r^2A_0\exp\left[-j\left(2\beta_{sw}x-k_0\sqrt{(x-x_F)^2+z_F^2}\right)\right] \end{aligned} \tag{13}$$

In Equation (13), only the second term on the right-hand side is the desired reconstructed object wave converging to the focal point; the first and third terms are residual slow waves, propagating along the wave-guiding structure as illustrated in FIG. 10B.

Figure 12A:
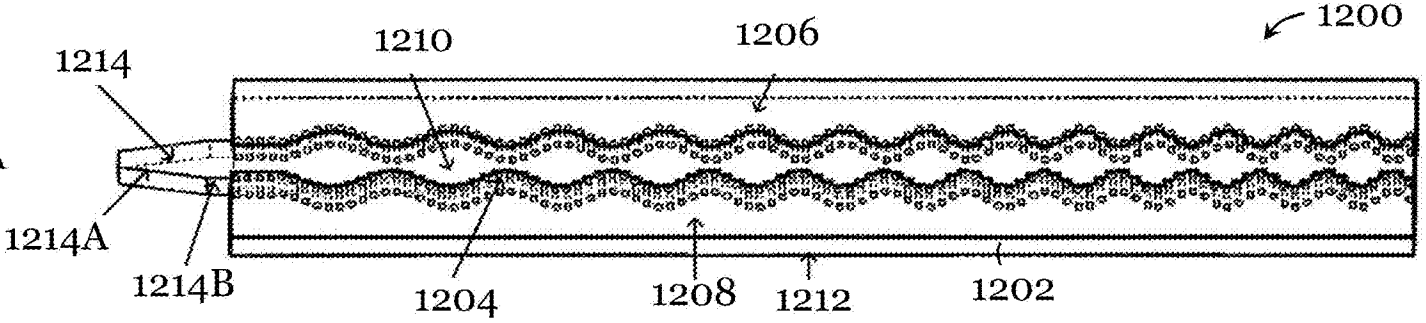
FIG. 12A is a schematic diagram of a leaky-wave antenna in another embodiment of the invention.
Figure 12B:
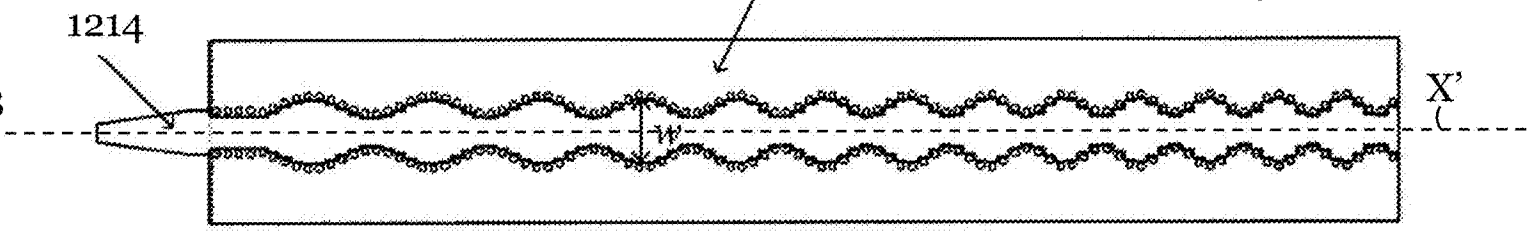
FIG. 12B is a top view of the leaky-wave antenna of FIG. 12A.
Figure 12C:
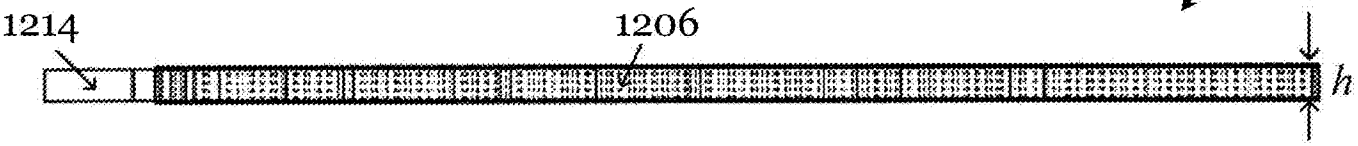
FIG. 12C is a side view of the leaky-wave antenna of FIG. 12A.

FIGS. 12A to 12C show an amplitude-modulated leaky-wave antenna 1200 in one embodiment of the invention. The leaky-wave antenna 1200 is a holographic amplitude-modulated leaky-wave antenna based on the substrate integrated inset dielectric waveguide. The leaky-wave antenna 1200 is particularly suited for near-field focusing applications. The antenna 1200 is similar to the antenna 500 so like components are labeled with like reference numbers plus "700".

As shown in FIGS. 12A to 12C, the leaky-wave antenna 1200 includes a substrate 1202 extending along an axis X', and a dielectric waveguide 1206 (transmission line) extending along the axis X' and arranged in the substrate 1202. The dielectric waveguide 1206 includes a top side, a bottom side, and opposite sides extending generally along the axis X' and between the top and bottom sides. The two opposite sides have a wavy contour such that distance defined between the opposite sides varies along the axis X'. In this embodiment, the distance defined between the opposite sides varies sinusoidally, with a gradually increasing frequency. In this embodiment, the dielectric waveguide 1206 is integrated with the substrate 1202 (e.g., the dielectric waveguide 1206 and the substrate 1202 are of the same dielectric material), and the substrate 1202 comprises two rows of metallic vias 1204 (e.g., via holes) that extend generally parallel to the axis X' to delimit or define the opposite sides of the dielectric waveguide 1206. The opposite sides of the dielectric waveguide 1206 are generally symmetric about the axis X'. As shown in FIG. 12B, a metallic layer 1208 is arranged on the top surface of the substrate 1202. A sinusoidal-modulated aperture pattern 1210 with the lateral width w is etched in or on the metallic layer 1208 such that the metallic layer 1208 does not cover the top side of the dielectric waveguide 1206. A ground plane 1212 is arranged on a bottom surface of the substrate 1202 to act as a one-sided shielding. In this example, the substrate 1202 and the dielectric waveguide 1206 both have a generally constant dielectric thickness, and the dielectric waveguide 1206 has a generally constant surface impedance. The leaky-wave antenna 1200 further comprises transition arrangement 1214 arranged to match an impedance between the dielectric waveguide 1206 and another feed waveguide. In this embodiment, the transition arrangement 1214 is directly connected with, e.g., integrally formed, the substrate 1202. The transition arrangement 1214 comprises a tapered/trapezoidal portion (dielectric substrate) 1214A that tapers along the axis X' away from the substrate and a rectangular portion (dielectric substrate) 1214B connected directly between the trapezoidal portion 1214A and the dielectric waveguide 1206. In this embodiment, the leaky-wave antenna 1200 can be implemented in or fabricated from a single-layer PCB substrate.

Figure 12D:
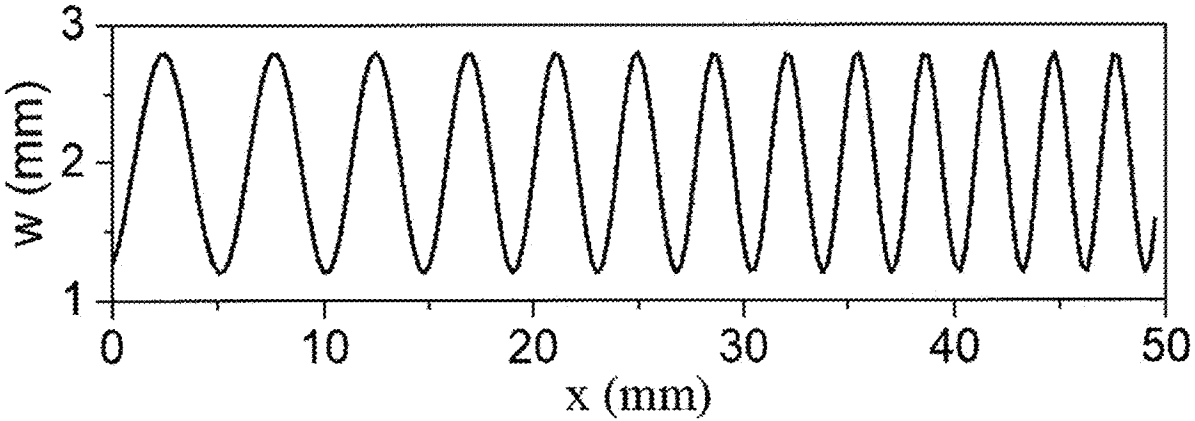
FIG. 12D is a graph showing aperture width distribution of the leaky-wave antenna of FIG. 12A.

FIG. 12D shows the aperture width w distribution of the leaky-wave antenna 1200 along axis X' or the dielectric waveguide 1206. In this embodiment, the aperture width w varies sinusoidally with a gradually increasing frequency.

Figure 13:
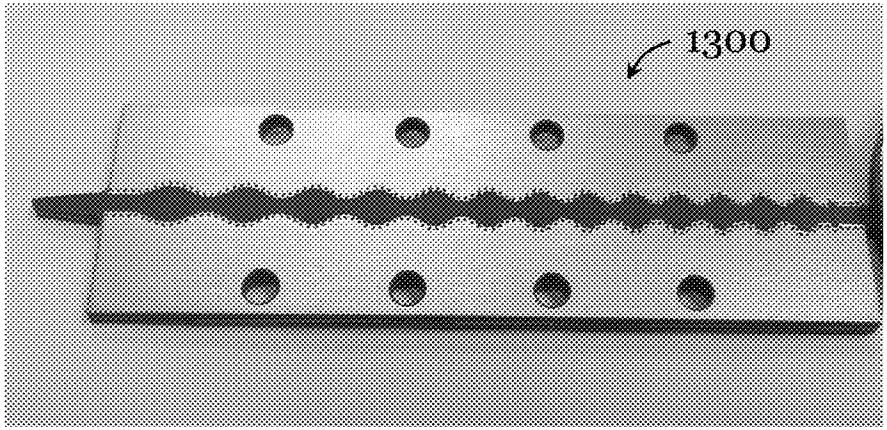
FIG. 13 is a photo of a leaky-wave antenna fabricated based on the leaky-wave antenna of FIG. 12A.

FIG. 13 shows a leaky-wave antenna 1300 fabricated based on the leaky-wave antenna design 1200 using standard PCB process.

Figure 14:
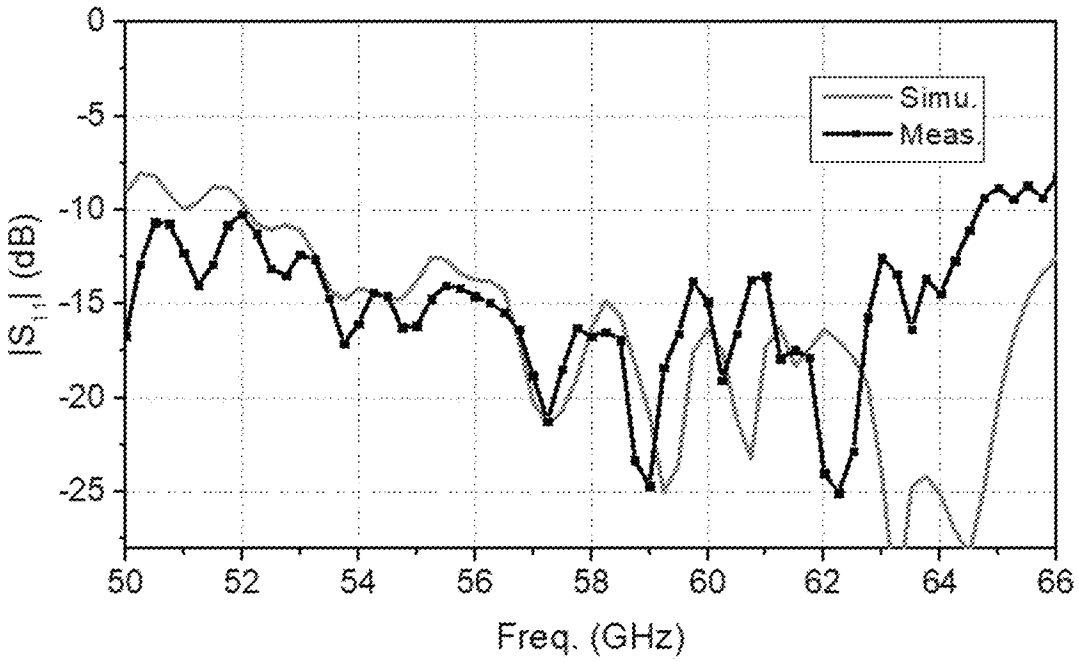
FIG. 14 is a graph showing simulated and measured $|S_{11}|$ value (dB) of the leaky-wave antenna of FIG. 13 for near-field focusing applications at different frequencies.

FIG. 14 shows simulated and measured $|S_{11}|$ value (dB) of the leaky-wave antenna of FIG. 13 for near-field focusing applications at different frequencies. As shown in FIG. 14, the measured $|S_{11}|$ is better than −10 dB from 50 GHz to 64.5 GHz.

Figure 15:
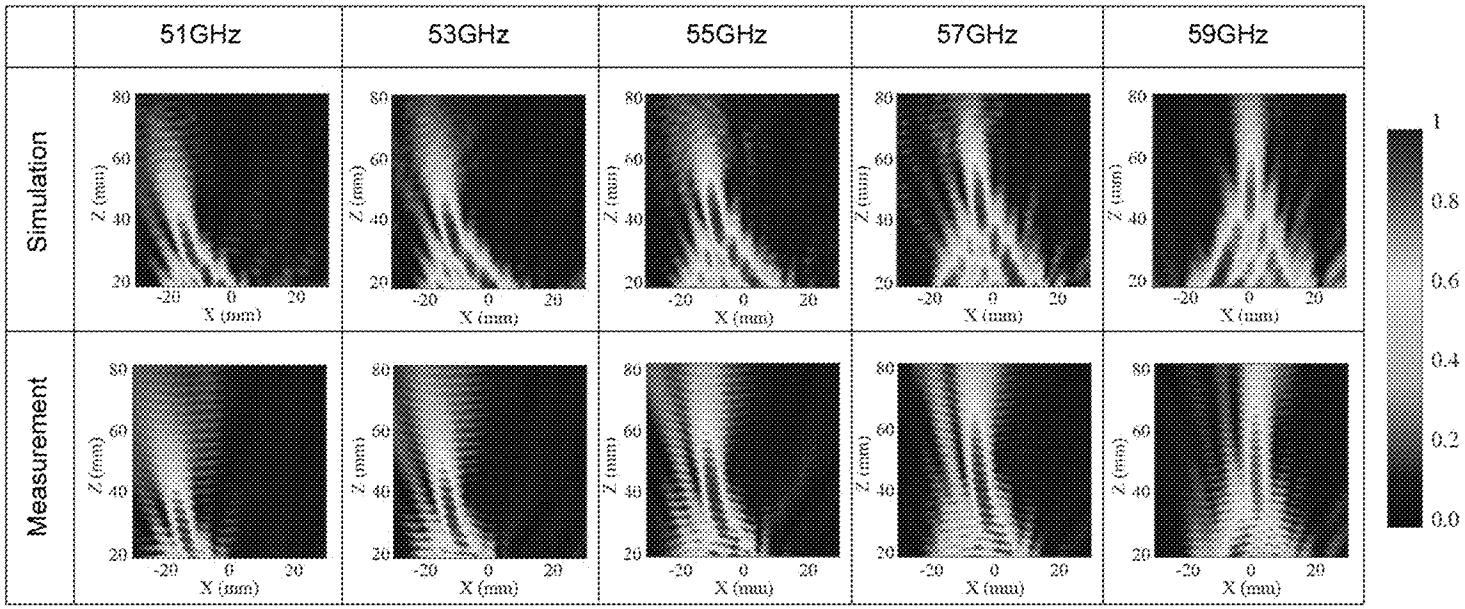
FIG. 15 is a plot showing simulated and measured near-field power intensities of the leaky-wave antenna of FIG. 13 in the xz-plane at different frequencies.

FIG. 15 shows simulated and measured near-field power intensities of the leaky-wave antenna of FIG. 13 in the xz-plane at different frequencies. As seen from FIG. 15, the simulated and measured results agree reasonably well. Some ripples can be observed in the measured results. This is primarily caused by the multiple reflections between the metallic receiving probe and the antenna under test in the near-field measurement process. It can be seen from FIG. 15 that the reconstructed electromagnetic wave from the holographic amplitude-modulated leaky-wave antenna 1300 can be concentrated into an ellipsoidal focal region around the desired focal point ($x_F$=−10 mm, $y_F$=0, $z_F$=40 mm) at 55 GHz. As the operating frequency increases, the focal point also scans from the backward towards forward directions due to the dispersion of the substrate integrated inset dielectric waveguide of the antenna 1300.

Other Amplitude-Modulated Leaky-Wave Antenna

Figure 16:
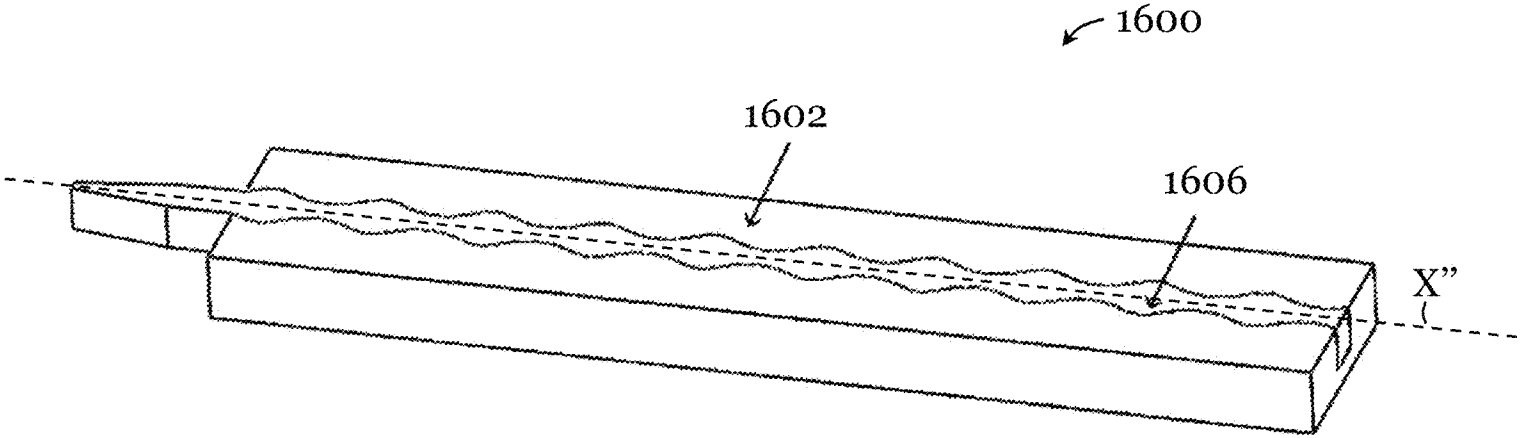
FIG. 16 is a schematic diagram of a leaky-wave antenna in another embodiment of the invention.

FIG. 16 shows a leaky-wave antenna 1600 in another embodiment of the invention. The structure of the leaky-wave antenna 1600 is similar to the structure of the leaky-wave antenna 500, 1200. However, in this embodiment, the leaky-wave antenna 1600 is manufactured using computer numerical control or additive manufacturing (e.g., 3D printing) technique in additional to PCB technique.

As shown in FIG. 16, the leaky-wave antenna 1600 includes a substrate 1602 extending along an axis X", and a dielectric waveguide 1606 (transmission line) extending along the axis X" and arranged in the substrate 1602. The dielectric waveguide 1606 includes a top side, a bottom side, and opposite sides extending generally along the axis X" and between the top and bottom sides. The two opposite sides have a wavy contour such that distance defined between the opposite sides varies along the axis X". In this embodiment, the distance defined between the opposite sides varies sinusoidally, with a gradually constant frequency. In this embodiment, the substrate 1602 has a metallic body defining a channel, and the dielectric waveguide is a dielectric slab arranged inside (e.g., inserted into, formed in, filled in, etc.) the channel. The opposite sides of the dielectric waveguide 1606 are generally symmetric about the axis X'. In this example, the substrate 1602 and the dielectric waveguide 1606 both have a generally constant dielectric thickness (the dielectric waveguide 1606 is thinner than the substrate 1602), and the dielectric waveguide 1606 has a generally constant surface impedance. The leaky-wave antenna 1600 further comprises transition arrangement 1614 arranged to match an impedance between the dielectric waveguide 1606 and another feed waveguide. The transition arrangement 1614 is similar or identical to the transition arrangement 514, 1214 in the above embodiments so will not be described in detail here.

CONCLUSION

Embodiments of the invention have provided a novel type of leaky-wave antenna by modulating the width of the inset dielectric waveguide. By simply varying the width of the inset dielectric waveguide, the wave-guiding structure can operate as a high-gain leaky-wave antenna for far-field or near-field focusing applications. In some embodiments, the leaky-wave antennas have a low profile, a simple feeding mechanism, and/or inherent frequency beam scanning capability. In some embodiments, the leaky-wave antennas can be easily implemented using standard PCB process and integrated with circuits for applications in microwave and millimeter-wave bands. At terahertz (THz) frequencies, the antennas may be implemented using typical CMOS or other similar technologies.

In some embodiments, the sinusoidal modulated inset dielectric waveguide-based leaky-wave antenna can realize high-gain pencil beam for far-field applications. In some embodiments, by properly selecting the modulating waveform, the inset dielectric waveguide-based leaky-wave antenna can concentrate the radiating electromagnetic wave into a small spot. The focal point can be scanned from the backward towards forward directions simply by increasing the operating frequency.

In some embodiments, the leaky-wave antenna is a high-gain leaky-wave antenna. The antenna of some embodiments may be used for millimeter-wave high-gain far-field applications, such as 5G wireless communications and radar systems, as well as for near-field focusing applications such as noncontact sensing, RFID system, millimeter-wave imaging, and wireless transmission energy systems. The antenna of some embodiments may be used for in microwave and THz bands, e.g., chip-to-chip or machine-to-machine communications in future 6G.

It will be appreciated by persons skilled in the art that numerous variations and/or modifications may be made to the invention as shown in the specific embodiments to provide other embodiments of the invention. The described embodiments of the invention should therefore be considered in all respects as illustrative, not restrictive. For example, the shape, form, size, etc., of the leaky-wave antennas in different embodiments may be varied depending on applications. In different embodiments, the leaky-wave antennas can be used for different applications, including but not limited to the far-field high-gain applications and near-field focusing applications. In different embodiments, the leaky-wave antennas may be arranged to operate in different frequency bands. While the specific embodiments provided in the disclosure mostly concern amplitude-modulated the leaky-wave antennas, it is envisaged that the invention can be applied more broadly to leaky-wave antenna in general. In different embodiments, the distance between opposite sides of the dielectric waveguide need not be sinusoidal but can vary differently (e.g., increases and decreases, periodically or non-periodically).

The invention claimed is:

1. A leaky-wave antenna comprising:

a substrate extending along an axis; and a dielectric waveguide extending along the axis and arranged in the substrate, the dielectric waveguide including, at least, a top side, a bottom side, and opposite sides arranged between the top and bottom sides;

wherein a distance defined between the opposite sides repeatedly increases and decreases along the axis for at least part of a length of the dielectric waveguide.

2. The leaky-wave antenna of claim 1, wherein the distance defined between the opposite sides varies sinusoidally along the axis for at least part of a length of the dielectric waveguide.

3. The leaky-wave antenna of claim 2, wherein the distance defined between the opposite sides varies sinusoidally with changing frequency along the axis for at least part of a length of the dielectric waveguide.

4. The leaky-wave antenna of claim 1, wherein the substrate comprises a dielectric substrate.

5. The leaky-wave antenna of claim 4, wherein the dielectric waveguide is integrated with the substrate; and wherein the substrate further comprises a plurality of metallic vias arranged in the dielectric substrate in, at least, two rows that extend generally along or parallel to the axis to delimit or define the opposite sides of the dielectric waveguide.

6. The leaky-wave antenna of claim 5, further comprising:

a metallic layer arranged on a top surface of the substrate; and a ground plane arranged on a bottom surface of the substrate.

7. The leaky-wave antenna of claim 6, wherein the metallic layer defines a groove corresponding to the top side of the dielectric waveguide such that the metallic layer does not cover the top side of the dielectric waveguide.

8. The leaky-wave antenna of claim 7, wherein the groove is an etched groove.

9. The leaky-wave antenna of claim 1, wherein the dielectric waveguide has a generally constant thickness defined between the top and bottom sides.

10. The leaky-wave antenna of claim 9, wherein the substrate has a generally constant thickness.

11. The leaky-wave antenna of claim 10, wherein the thickness of the dielectric waveguide is smaller than the thickness of the substrate.

12. The leaky-wave antenna of claim 10, wherein the thickness of the dielectric waveguide is the same as the thickness of the substrate.

13. The leaky-wave antenna of claim 1, wherein the substrate comprises a body defining a channel, and the dielectric waveguide is arranged inside or filled in the channel.

14. The leaky-wave antenna of claim 13, wherein the body is a metallic body.

15. The leaky-wave antenna of claim 1, further comprising a transition arrangement arranged to operate as an impedance transformer for insertion into another waveguide to excite a fundamental mode of the dielectric waveguide.

16. The leaky-wave antenna of claim 15, wherein the transition arrangement is directly connected with the substrate.

17. The leaky-wave antenna of claim 15, wherein the transition arrangement is integrally formed with the dielectric waveguide.

18. The leaky-wave antenna of claim 15, wherein the transition arrangement comprises a tapered transition that tapers along the axis away from the substrate.

19. The leaky-wave antenna of claim 15, wherein the transition arrangement comprises a trapezoidal portion that tapers along the axis away from the substrate and a rectangular portion arranged between the trapezoidal portion and the dielectric waveguide.

20. The leaky-wave antenna of claim 1, wherein the dielectric waveguide is an additively manufactured dielectric waveguide.

21. The leaky-wave antenna of claim 1, wherein the leaky-wave antenna is operable in microwave and millimeter-wave bands.

22. The leaky-wave antenna of claim 1, wherein the leaky-wave antenna is operable for far-field high-gain applications.

23. The leaky-wave antenna of claim 1, wherein the leaky-wave antenna is operable for near-field focusing applications.

24. A leaky-wave antenna comprising:

a substrate extending along an axis; and a dielectric waveguide extending along the axis, and arranged in and integrated with the substrate, the dielectric waveguide including, at least, a top side, a bottom side, and opposite sides arranged between the top and bottom sides;

wherein a distance defined between the opposite sides varies along the axis for at least part of a length of the dielectric waveguide; and wherein the substrate comprises a dielectric substrate, and a plurality of metallic vias arranged in the dielectric substrate in, at least, two rows that extend generally along or parallel to the axis to delimit or define the opposite sides of the dielectric waveguide.

25. The leaky-wave antenna of claim 24, further comprising:

a metallic layer arranged on a top surface of the substrate;

wherein the metallic layer defines a groove corresponding to the top side of the dielectric waveguide such that the metallic layer does not cover the top side of the dielectric waveguide.

26. The leaky-wave antenna of claim 24, further comprising a transition arrangement arranged to operate as an impedance transformer for insertion into another waveguide to excite a fundamental mode of the dielectric waveguide.

27. A leaky-wave antenna comprising:

a substrate extending along an axis;

a dielectric waveguide extending along the axis and arranged in the substrate, the dielectric waveguide including, at least, a top side, a bottom side, and opposite sides arranged between the top and bottom sides; and a transition arrangement arranged to operate as an impedance transformer for insertion into another waveguide to excite a fundamental mode of the dielectric waveguide;

wherein a distance defined between the opposite sides varies along the axis for at least part of a length of the dielectric waveguide.

28. The leaky-wave antenna of claim 27, wherein the transition arrangement comprises a tapered transition that tapers along the axis away from the substrate; or wherein the transition arrangement comprises a trapezoidal portion that tapers along the axis away from the substrate and a rectangular portion arranged between the trapezoidal portion and the dielectric waveguide.

* * * * *